US009605845B2

(12) United States Patent
Chien

(10) Patent No.: US 9,605,845 B2
(45) Date of Patent: Mar. 28, 2017

(54) LED LIGHT WITH MANUALLY OPERATED SOUND DEVICE

(71) Applicant: Tseng-Lu Chien, Walnut, CA (US)

(72) Inventor: Tseng-Lu Chien, Walnut, CA (US)

( * ) Notice: Subject to any disclaimer, the term of this patent is extended or adjusted under 35 U.S.C. 154(b) by 0 days.

(21) Appl. No.: 14/106,015

(22) Filed: Dec. 13, 2013

(65) Prior Publication Data

US 2015/0167957 A1 Jun. 18, 2015

(51) Int. Cl.

| | |
|---|---|
| ***F21V 33/00*** | (2006.01) |
| ***F21S 9/02*** | (2006.01) |
| ***F21L 4/02*** | (2006.01) |
| ***F21V 23/04*** | (2006.01) |
| *F21W 111/10* | (2006.01) |
| *F21Y 101/00* | (2016.01) |

(52) U.S. Cl.

CPC ..... *F21V 33/0076* (2013.01); *F21L 4/02* (2013.01); *F21S 9/024* (2013.01); *F21V 23/0442* (2013.01); *F21W 2111/10* (2013.01); *F21Y 2101/00* (2013.01)

(58) Field of Classification Search

CPC ..... F21S 9/022; F21S 9/024; F21V 33/076

See application file for complete search history.

(56) References Cited

U.S. PATENT DOCUMENTS

| | | | | |
|---|---|---|---|---|
| 4,697,228 A * | 9/1987 | Mui | F21L 4/02 | 362/208 |
| 4,744,013 A * | 5/1988 | Lee | G08B 7/06 | 362/109 |
| 5,806,961 A * | 9/1998 | Dalton | F21L 4/025 | 362/183 |
| 2010/0085738 A1* | 4/2010 | Bertken | F21L 4/02 | 362/157 |

* cited by examiner

*Primary Examiner* — Andrew Coughlin

(74) *Attorney, Agent, or Firm* — Bacon & Thomas, PLLC

(57) ABSTRACT

An LED light has a built-in, added-on, or snapped-on sound device such as a whistle to allow people to generate a loud sound that can be heard by other people during conditions such as an earthquake, flood, typhoon, hurricane, tornado, fire, bombing, tsunami, terrorist attack, and so forth. The LED light normally serves as non-portable light device which can be installed in a certain location, but which can be removed in the event of an emergency to serve as a power fail or emergency light. The LED light, without the sound device, may also be applied to an electrical outlet wall plate cover.

11 Claims, 6 Drawing Sheets

LED LIGHT WITH MANUALLY OPERATED SOUND DEVICE

This invention is a Continuation-in-Part of U.S. patent application Ser. No. 13/402,247, filed Feb. 22, 2012 and Ser. No. 13/910,295, filed Jun. 5, 2013.

BACKGROUND OF THE INVENTION

The current invention has subject matter in common with the inventor's U.S. Pat. Nos. 8,083,376 and 6,179,431. The current invention also has subject matter in common with the inventor's U.S. patent application Ser. No. 12/938,628 ("LED Light Fixture has Outlets and Removable LED Unit(s)") and U.S. Pat. No. 7,318,653.

Currently marketed LED lights include flash lights, power fail lights, light bars, and other light devices having LED-element(s) as light sources to replace the out-of date incandescent bulbs for less power consumption, compact size, long burn time, long life, etc. However, these LED light device all lack sound means to help people create a sound loud enough to be heard when facing bad situations.

The inventor's issued patents include U.S. Pat. No. 8,083,376, which is directed to a power fail light that features power saving, compact size, longer burn-time as a result of an LED being applied as the light source instead of out-of-date incandescent bulbs, so that the size of the power fail light (or flashlight, light bar, or other light device) become very small. All of these light devices available in the market have become very compact, for example cigarette lighter size or mini hot-dog size, which is so small that it is difficult to find the flash light, power fail light, light bar, or other LED device when needed.

Unlike a flash light, power fail light, light bar, or other LED device people, some devices such as a home phone still keep the same bulky size, rather than being reduced to mini hot-dog size, because people's head size from ear to mouth has not been reduced to that of a mini size hot-dog. The same should be true for a flash light, power fail light, light Bar, or other LED device that is intended to be handheld and therefore must fit people's hand size or be good for palm holding to cause people to feel safe while using these device(s) during an emergency or hazard time. Such flash lights, power fail lights, light bars, or other LED devices invoke a traditional image deep inside human memory, and so it is not at all good to make then a compact size.

The current invention applies the LED element(s) described in the inventor's U.S. Pat. No. 8,083,376 and earlier issued U.S. Pat. No. 7,318,653 as light sources to keep the advantages of power saving, long burn time, light source long life, etc., but keeps the same bulky size as earlier incandescent handheld lighting device by providing one housing with more than one LED light device, including at least one big one for adults and at least one small LED light device for children or kids so that their smaller hands can hold it.

In addition, the current invention provides a removable or permanent built-in sound generating means, which can be very helpful for people and even save their lives.

It will be appreciated that the current invention can utilize additional features described in the inventor's above-mentioned copending or issued patent applications, or other additional features, variations, and modifications, and that the current invention is not limited to the drawing, detailed description, and other content of the present application.

DETAILED DESCRIPTION OF THE PREFERRED EMBODIMENTS

Figure 1:
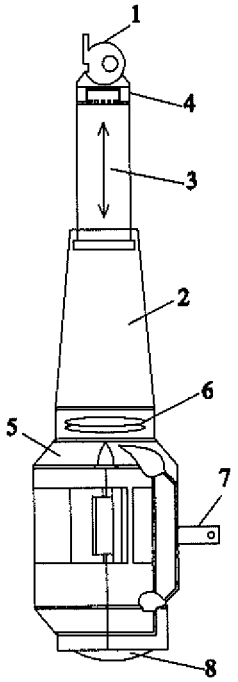
FIGS. 1, 1A, and 1C are side views of an LED light according to a first preferred embodiment of the invention.
Figure 1A:
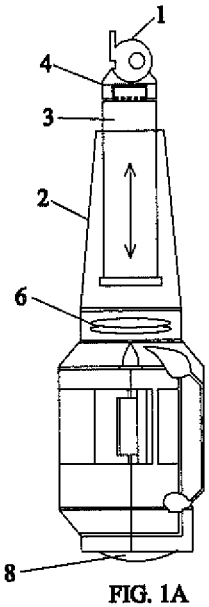
Figure 1B:
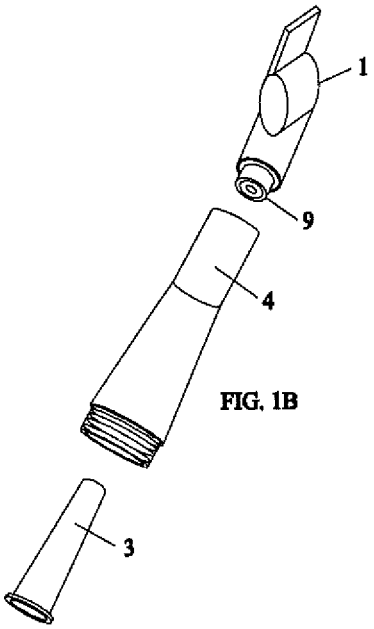
FIG. 1B is a perspective view of the LED light of FIGS. 1, 1A, and 1C.
Figure 1C:
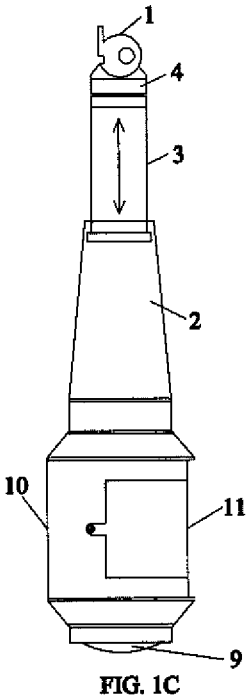
Figure 2:
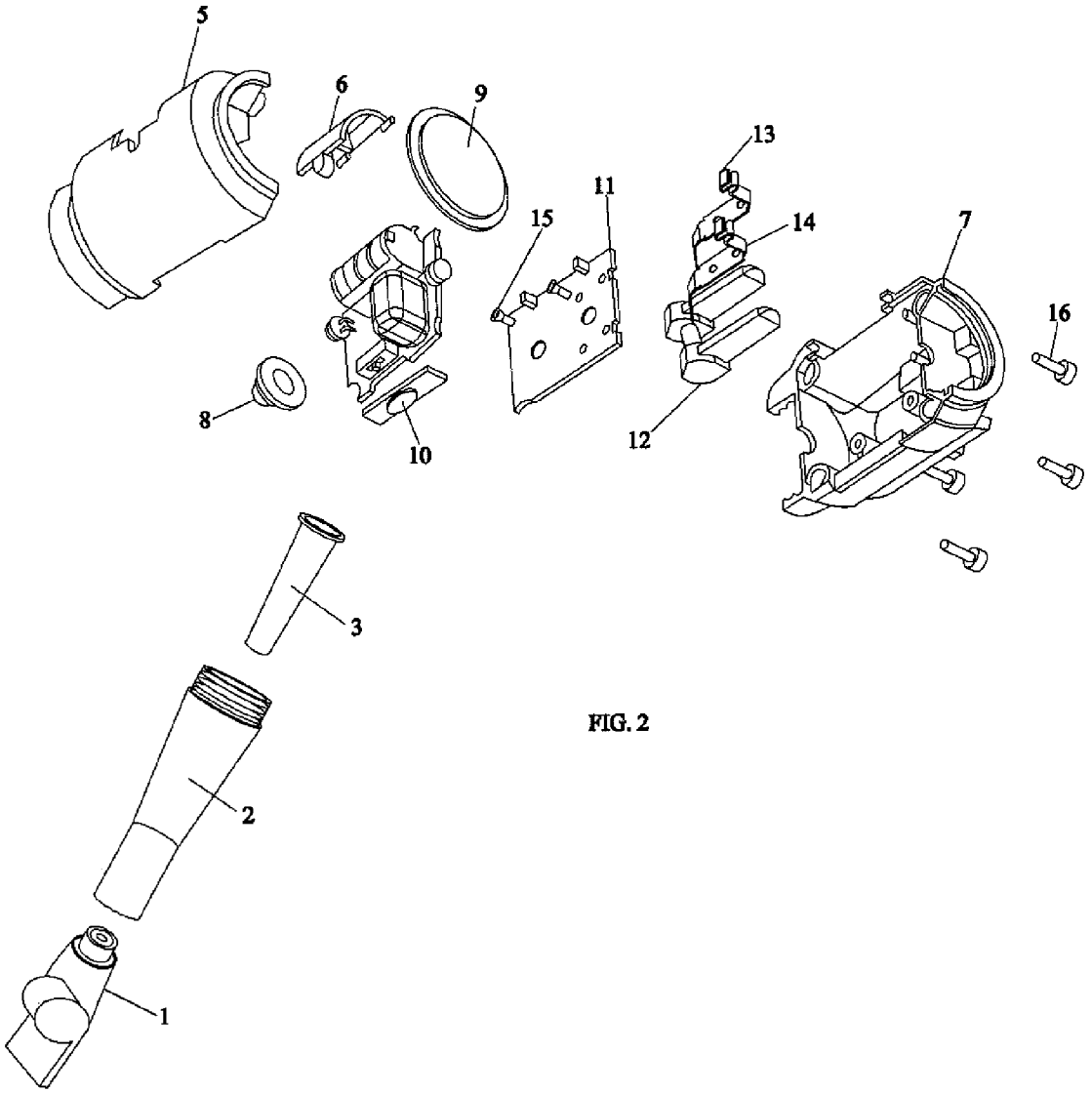
FIGS. 2, 3, and 4B are exploded perspective views showing details of the preferred embodiment of FIGS. 1 and 1A-1C.
Figure 3:
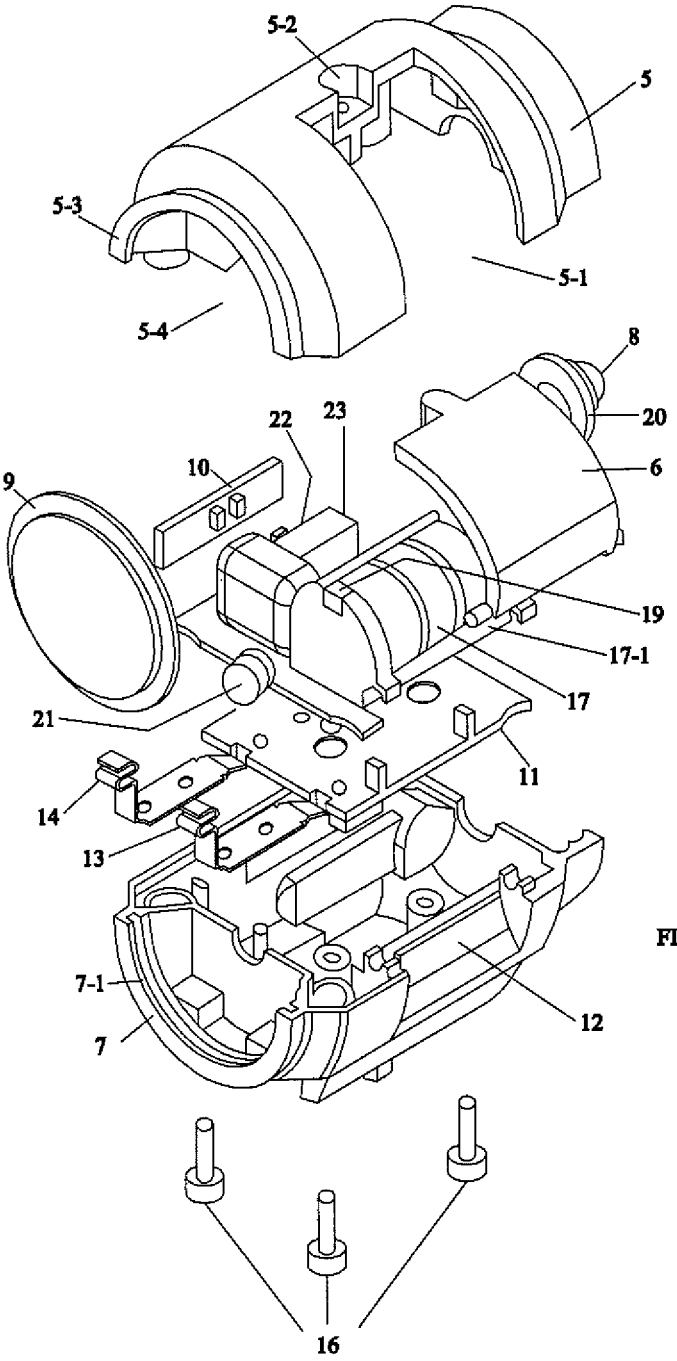
Figure 4B:
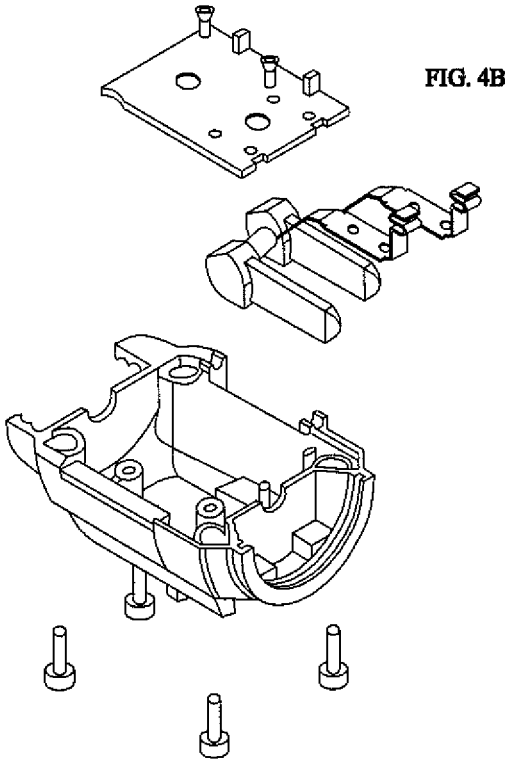
Figure 4A:
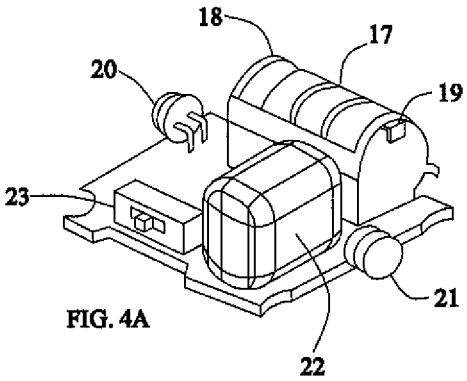
FIG. 4A is a perspective view showing further details of the embodiment of FIGS. 1 and 1A-1C.
Figure 5A:
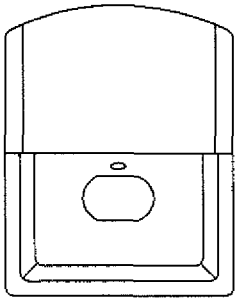
FIGS. 5A and 5B are front views of a power fail light in accordance with second and third preferred embodiments of the invention.
Figure 5B:
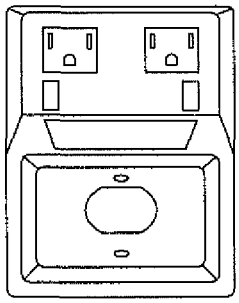
Figure 6A:
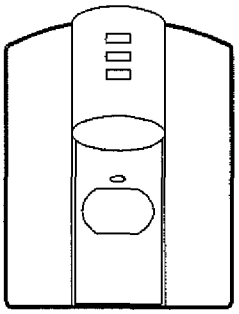
FIGS. 6A and 6B are respective front and perspective views of a power fail light in accordance with fourth and fifth preferred embodiments.
Figure 6B:
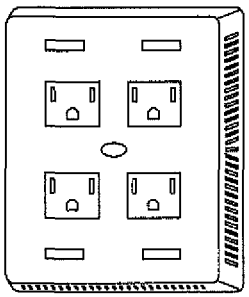

FIGS. 1, 1A, 1B, and 1C show a first preferred embodiment of an LED power fail light having a first LED 5 that serves as a night light to offer area illumination from an extendable tube 3 and body tube 2 while a foldable prong means 7 is plugged into a wall outlet power source to obtain power and provide predetermined functions under control of an electric control means and the extendable tube 3 is retracted into the body tube 2, as shown in FIG. 1B, or extended as shown in FIGS. 1 and 1C. A second LED 8 and lens 9 installed at the bottom of a base 10 is turned on or off automatically or manually by a circuit means and powered by a battery contained in a compartment having door 11 when the foldable prong means 7 is unplugged and the extendable tube 3 is extended from the body tube 2. The and second LEDs further incorporate electric control means selected from any combination of a sensor, switch, IC, motion sensor, infrared sensor, Bluetooth, remote control or other electric or mechanical means available from the marketplace. The LED power fail light has a sound or siren means 1, which is illustrated by way of example as a whistle, and provided within, added-on, fixed-on, or installed on a top base 4 of the housing of the power fail light to enable a person to make a super loud sound that can be heard at a faraway distance or through building materials.

FIGS. 2, 3 4A, and 4B show further details of the construction, parts, and assembly of the power fail light of the first preferred embodiment, including the above-described first LED (reference number 8 in FIGS. 2 and 3, and 20 in FIG. 4B), lower base housing halves (reference numbers 5,7), second LED (reference numeral 21 in FIGS. 3 and 4A), optics lens 9, body tube 2, extend tube 3, sound generating means in the form of a whistle 1, battery terminals 18 and 19, batteries 17, electrical parts 22, battery compartment door (reference number 6 in FIG. 2), a switch 23 and switch cover 10, a printed circuit board 11 with posts 15, prongs 12 extending from contacts 13,14, and screws 16 for securing the respective base housing halves 5,7 to each other.

FIGS. 5A, 5B 6A, and 6B, second through fifth embodiments of an LED power fail light in the form of a wall cover LED light that can replace an existing wall cover plate and be fastened in an existing outlet's holes. The standard outlet has two oval-like outlets with one center fastening hole and top and bottom fastener holes or, for decorative outlet kits, rectangular shape outlets and only the two top and bottom holes. The current invention wall cover LED light not only supplies area illumination for any purpose or application using a first LED but also supplies light from a second LED for use as an emergency light, power fail light, or evacuation light for people to use when facing a bad environment or condition such as an earthquake, flood, typhoon, hurricane, tornado, fire, bombing, tsunami, terrorist attack, etc. More functions may optionally be added based on market requirements, including outlets, a USB charger, an air freshener, additional LED lights, a time piece, a projection light, a movable light, a remote control device, an infrared device, a Bluetooth device, and/or a motion sensor device.

Figure 7A:
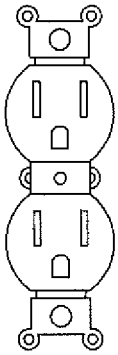
FIGS. 7A to 7F are respective front and perspective views of sixth to eleventh preferred embodiments of the invention.
Figure 7B:
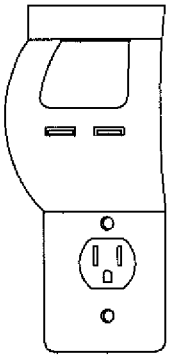

FIGS. 7A, 7B, 7C, and 7D show an inner unit of the wall outlet, which can be (1) a standard type having two oval-like shaped receptacles with one center and two top/bottom screw holes, as shown in FIGS. 7A and 7B, or (2) a decorative type which has two rectangularly-shaped receptacles but only two top/bottom screw holes to allow people to fasten the existing wall cover plate or the current invention wall cover LED light.

Figure 7C:
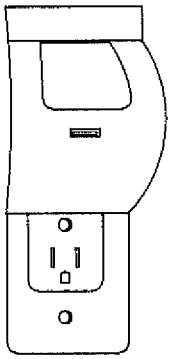
Figure 7D:
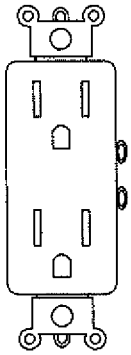

FIG. 7D shows how to make the universal wall cover LED light fit the (1) standard type wall outlet of FIG. 7A and (2) the decorative type outlet of FIG. 7D. A movable plate is needed which is pressed tight, physically fitted, or snapped-on the wall cover LED light because the majority of wall outlets include two receptacles of the type illustrated in FIG. 7A. However, when the consumer has a decorative type outlet inner unit of the type shown in FIG. 7D, then the movable plate is removed so that the outlet opening of the wall cover becomes square as shown in FIG. 7C.

Figure 7E:
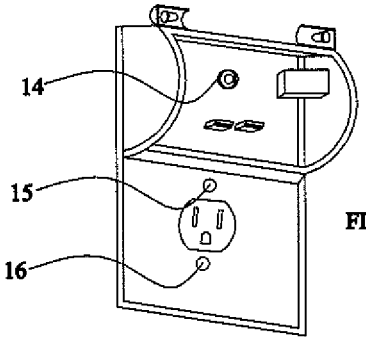

FIG. 7E shows a preferred embodiment in which the wall cover LED light 18 has conductive wires 17 rather than prong means to connect with the power source. The wall cover LED light has a first LED to form a shaped lighted area or geometric shape light performance that not only offers the appearance of an accent light but also can offer the area illumination. During a power failure, the rectangular accent light provides a super strong second LED light function as an emergency light, power fail light, or evaluation light. Furthermore, the light area is not limited by the wall outlets opening size and shape. Instead, the wall cover LED light has a much bigger size than the wall opening of standard type. The bigger or wider wall cover LED light can have extra space which extends from four sides of the traditional wall cover to provide a light performance without blocking out the original two outlets. This is accomplished by using the conductive wires 17 and assembly by professional electric engineers to still give people two outlets to use. It will be appreciated that any alternative, replacement, or equivalent, design, products, or concept may still fall within the scope of the current invention.

Further understanding of the drawings and the current invention's features can be obtained from the following discussion:

The current invention has subject matter in common with the inventor's copending U.S. patent application Ser. No. 13/402,247 and U.S. Pat. Nos. 8,083,376 and 6,179,431.

The current invention provides an LED light device that has at least one first LED for normal indoor lighting and at least one second LED for emergency use as also described in the inventor's related applications and patents cited above. The current invention adds a very important sound or siren means which can allow people to use it to make a loud sound while in a dangerous situation so that rescuers can find the people. According to the current invention, the sound or siren means is not powered by a battery or energy storage means because such a battery power or energy storage device only can last for a very short time and because the majority use rechargeable batteries which have a bad memory issue or a running time of less than 8 hours. This is not a enough time to satisfy the needs of people in need of rescue, who might have to wait 72 hours for rescuers to be within hearing range. Current market-available items are of no use in such a situation. In the a whistle is especially advantageous because it only requires use of a human mouth to blow a tiny amount of air and yet generate a very loud sound that people can hear from miles away.

To have the human body operate the sound or siren device is the best choice and also has the advantage that no one will steal such a human-operated sound or siren device when kept in a public or indoor place for emergency use.

The current invention thus provides a multiple function LED light device having both an LED light function and at least one function to enable emergency, power fail use, such as a human-body-operated sound or siren means that creates a high volume sound that can get people's attention from miles away.

Mr. Bertken's U.S. Pat. Nos. 7,845,820, 8,113,682, 8,186,846 disclose a flash light with a permanent whistle on top, but the whistle is not removable so it is difficult to for people to get their lips around the whistle during emergency use. That is not practical because on always has to hold the long glow stick by hand. It also too long a unit so that in a bad environment there might not be a big enough space to let people use. In the current invention, sound or siren means is preferably removable from the LED light device. As long as there is a space equal to a distance from nose tip to mouth, one can use the movable whistle to call for help. This is a main feature.

Other differences between the flashlight disclosed in Mr. Berken's patents and the current invention include the following:

a. The power sources for prior flashlight and the LED light of the current invention are different: the prior flashlight uses a battery while the current invention is normally connected to an external power source and used in one place to provide indoor LED lighting.
b. The circuit constructions are totally different: The prior construction is a simple direct current LED circuit. The current invention includes voltage drop, current limitation, and protective circuitry required for fixed indoor use when not being used as an emergency light.
c. The current invention includes foldable prong means: The prior flashlight has no need for prongs because the flashlight is a portable device.
d. Mr. Berken's flashlight uses three button cell batteries, which is not enough to enable the flashlight to last the golden 72 hour window of survivability before a rescue team must come to help.
e. The current invention has an extendable length so that the unit can become short enough to be used in a tiny space while waiting to be saved. Berken's fixed-length flashlight is not suitable for use in a very confined space.

This embodiment of the invention thus provides an LED light having sound means that further includes:

at least one first LED as a light source for the LED light and at least one second LED as light source for a power fail light or flashlight or emergency light. Each of the light sources has a common or separate working system with the other light source and is connected with circuit means and electric parts and accessories selected from one or more of the following elements: switch means, sensor means, Bluetooth means, motion sensor means, infrared means, a photo sensor, remote control means, prong means, USB means, pigtail means, desk top means, base means, housing means, extendable housing means, a power source, installation means, conductive means, resilient conduction means, USB means, USB plug and receiving means, adaptor means, transformer means, false prong means, sound means, whistle means, removable LED units, movable LED units, connector means, quick assembly means, screw means, snap tight means, and physical fitting means. The first LED light source supplies area illumination and may be in the form of an LED Night light, LED light fixture, LED under-cabinet light, LED wall cover light, LED camping light, LED remote control light, LED Bluetooth light, LED motion sensor light, LED garden light, LED desk lamp, LED security light, LED entrance light, and LED garage light, while the second LED light source serves as a power fail light, emergency light, flashlight, or evacuation light.

The first and second light sources connect with the circuit means and power source, and the power source may include one or more of the following: alternating current (AC) power from a wall outlet (AC) or direct current (DC) power from USB, batteries, solar power, wind power, chemical power, DC power storage means, or any other market-available energy means to cause the LEDs to turn on under predetermined functions, performance, effects and color, brightness, time period, and time delay.

The first light source application is a non-portable device which cannot be carried by people while walking or moving, and which does not offer illumination having changeable directions, height, distance, and focus features. The first light source is limited to illumination of a certain location, position, or area for a period of time.

The at least one sound means or siren means is arranged within, or fixed, installed, added-on, clipped-on, attached-to, snapped-on, twisted-on, glued-on, or riveted-on the LED power fail light.

The sound means can create a very big sound to let people hear the sound over a large distance, and through sound blocking means such as mud, sand, walls, a roof, cement, concrete, brick, wood, or any other material which may be used in a house, building, office, playground, or residence where humans stay.

The sound means or siren means is a non-power operated device which can only be operated by mouth, hand, feet, arms, or legs of a human body. The sound means or siren means therefore does not use an energy storage means, battery means, or electric current means because such power means can only be operated for a limited time period which does not give people enough time to get through a crisis, hazard, or emergency condition and create a loud enough voice, sound, or signal to the rescue teams.

The LED light device of this embodiment thus has more than two functions, as follows:

At least one first LED and second LED are connected with circuit means and electric parts and accessories that may include one or more of the following: switch means, sensor means, Bluetooth means, remote control means, motion sensor means, foldable prongs, extendable housing means, snap tight housing parts, a second function device, and a second light device to cause the first and second LEDs to turn on under predetermined times, duration, color, and brightness to get light effects.

The first is powered from a wall outlet, USB outlet, extension cord, power strip, transformer, or adaptor power and selected contact means that may include one or more of prongs, USB means, pigtail means, conductive means, wire means, and resilient conductive means as well as other circuit means and electric parts and accessories.

The second LED is powered from batteries, energy storage means, chemical energy means, wind power, solar power, invertor, transformer, and adaptor means as well as contact means that may include one or more of a conducive metal piece, battery bracket, battery terminals, battery rack, battery container, wire means, solder means, spring contract, resilient conductive means, and other circuit means and electric parts and accessories.

The first LED may serve as one or more of a night light, desk top LED light, plug-in LED light, LED plug-in wall cover light, LED desk-top accent light, LED remote control light, LED motion sensor light, LED Bluetooth light, and LED light fixture for non-portable use.

The second LED is preferably one of an LED power fail light, LED emergency light, evacuation light, LED torch, and LED flashlight, and is connected with direct current directly or indirectly.

The sound means can be non-removable or removable from the LED light.

According to another embodiment of the invention, the invention provides a wall cover LED light device that includes at least one first LED that serves as a light source within the housing for a night light and at least one second LED that serves as a power fail light, emergency light, or evacuation light and that can be fixed on or removed from the housing.

The wall cover LED light includes at least one prong means to be inserted into wall outlets or used as conductive means to connect with the wall outlets inner unit to get electric current and connect with any combination of circuit means, switch means, sensor means, control means, remote control means, Bluetooth means, infrared means, electric parts and accessories, resilient conductive means, LED rotating means, and wire means to cause the first LED to have a night light function and the second LED to serve as a power fail light, flash light, emergency light, or evacuation light, or any desired combination of the listed types of lights.

The wall cover LED light has preferred parts and accessories selected from screw means, connect means, fixing means, fastening means, and quick connect means to replace the original wall cover plate and install the current wall cover LED light using the existing wall outlet's inner holes, which for standard dual oval-shape outlets includes one center hole and two top-bottom holes or, for square-shaped outlets, only has two top/bottom holes to safely install the wall cover LED light.

The wall cover LED light also has a built-in moveable piece to enable the wall cover LED light to fit standard outlets (2 oval-like receptacles) or decorative outlets (2 square-like receptacles) inner unit. The moveable-piece can stay on the wall cover LED light when installed on standard outlets having the 2 oval-like receptacles, or can be moved-out when the wall cover LED light is install on decorative outlets having the rectangular-like outlets.

The wall cover LED light's first LED night light can be arranged anywhere a similar size original wall cover plate is installed, or may extend from each side of the original wall cover plate, including the top, bottom, left, or right side.

The wall cover LED light has at least the above-mentioned night light and power fail light functions, and may add one or more of the following devices to provide additional function(s): whistle device, sound device operated by human body, USB charger, remote control device, Bluetooth device, infrared device, motion sensor device, air freshener device, time device, projection device, power outlet device, fiber optic device, motor device, and weather device.

Returning to FIGS. 1, 1A, 1B, and 1C, the whistle on the top of the LED light unit may be permanently installed, or snapped-on or added-on to the top of the LED light. The whistle uses a whistle base to be snapped-on or added-on to the top of the LED light's extendable tube 3, which can extend out from the body tube 4 when needed for longer length such as for traffic control, evacuation direction, or emergency use. The LED light of this embodiment preferably has foldable prongs to allow the LED light to be plugged into wall outlets, a power strip, an extension cord, or a wheel power cord to obtain AC current from these different power sources and cause the LED light to provide a night light function on normal days. The LED light may include night light any of the features described in the inventor's pending patent applications and issued patents, such as a photo sensor, motion sensor, remote control, Bluetooth, infrared or other switch means, sensor means, trigger means, IC chip, multiple LEDs, more than one reflective means, more than one function, and more than one optic means.

As shown in FIGS. 1A and 1B, the LED light is retractable to provide a shorter body when there is no need for long length because the LED light is being used as a night light. When the LED light is extended, it can be used as a baton to show people which direction to move or to indicate a car driving direction. The extended LED light can also be used to show a location. FIG. 1A is a side view of how to make the tubular LED light have different lengths and how to make the prong means foldable so that the user can easily fold the prongs when the LED light needs to be hand carried according to the second light source application. In the first light source application, the LED light is fixed at a certain location, place, or area to offer illumination without moving the LED light. However, when the second LED light source is being use for an emergency, hazard, earthquake, flood, or hurricane, the prong needs to fold-up and the unit become a portable device to enable people to carry it with them or use it for illumination or to call for help by making a loud sound using the sound or siren means so that the user's throat will not get hurt as a result of screaming.

As shown in FIG. 1C, a battery cover is provided so that the user can easily replace batteries when needed. The battery cover has screws to fasten the cover and prevent kids from taking out and swallowing the batteries, which can be very dangerous.

The details shown in FIGS. 2, 3, 4A and 4B are discussed above and not repeated here.

FIGS. 5A, 5B, 6A, 6B, and 7A-7F show variations of the wall cover LED light having a different construction and design, including the following features:

(1) The wall cover LED light may provide more than two functions, including various combinations of a power outlet function, a USB Charger function, and a USB hub function (signal delivery rather than 500 ma up to 10,000 ma current delivery) with such additional functions as an air freshener, moisture spray, bug repeller, movable LED light units (similar to the removable light units described in the inventor's issued patents), projection light, projection image, time display, and timepiece.

(2) The wall cover LED light may include more than one screw hole—depend on market requirements. For example, a universal unit may have three screw holes so it can fit both standard outlets with two oval-like receptacles having a center hole and top/bottom screw holes and decorative outlets having two outlets receptacles with a rectangular shape but only top and bottom screw holes.

(3) The wall cover LED light may have a decorative cover (not shown) to cover the screw holes, which is in the form of a tiny plastic cover arranged to be put on top of the holes so that no visible holes will spoil the pretty appearance.

(4) The wall cover LED light may use a Hing-type optics lens to cover screw holes as shown in FIGS. 7B and 7C, which use an optics lens having a sand blaster treatment or an opaque lens to cover the inner top screw hole. This allows people to easily add a screw for the top screw hole when using the wall cover LED light with a decorative outlet unit that has no center screw hole.

(5) The wall cover LED light may include a USB hub that only carries digital data and not a 500-10,000 ma charging current.

(6) The wall cover LED light may also or alternatively include a USB charger which has current to charge other electric devices such as smart phones, computers, cameras, digital devices, music players, iPads™, iPhones™, communication or computer or consumer products, and other electric devices that need electric current to function.

The illustrated wall cover LED lights are not limited to the specific examples shown in the drawings. It is to be appreciated that any plug-in, wired, or other electric connection wall cover LED light should still fall within the scope of the current invention, including wall cover LED lights with features disclosed in the inventor's earlier patents and patent applications, such as more than one LED, more than one function, and more than one optics means, for any plug-in or desk top AC or DC applications.

FIGS. 7A and 7D shown the two different types of major market outlet units, which have different number of screw holes to allow people to fasten or fix the wall cover plate.

FIGS. 7B and 7E show the same wall cover LED light having the optics lens on top, which is hinge-construction that can pivot and down to allow people to add a top screw though the top screw hole. It also show how the wall cover LED light is universal to fit the two major outlet unit types, including the standard outlet unit of FIG. 7A and the decorative outlet unit of FIG. 7D.

As shown in FIG. 7E, the moveable piece is a key to make the current wall cover LED light fit both the standard and decorative outlet units. The movable piece can be fix on the inner side of the wall cover LED light, and also can be pushed if the movable piece is not needed for the decorative outlet unit. This is very simple concept, but very important for people to buy one and universal product that fits all outlets.

Figure 7F:
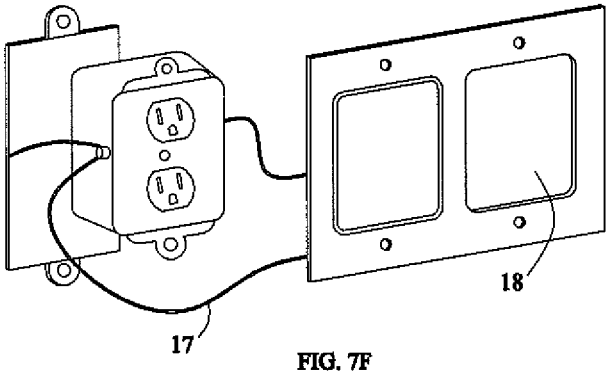

As shown in FIG. 7F, shown the wall cover LED light is not limited to a size similar to that of the existing wall cover plate for two oval-shaped openings. The wall cover plate can have any shape and size that covers the wall plate, including sizes that are much bigger than an existing wall plate and that can extend from all sides so as to also provide a side light design.

It will be appreciated that the wall cover LED light is not limited to using prong means to provide electricity delivery from the existing wall AC power source. It can use conductive wires as shown in FIG. 7E, or other elastic conductive means such as copper contacts on the top-end of elastic plastic pole to contact the positive and negative screws on the two sides of the outlet units shown in FIGS. 7A and 7D to deliver electricity.

It will also be appreciated that the wall cover LED light not only may have at least one first LED light source to act as a normal LED light and at least one second LED light source to act as a power fail light, emergency light, or evacuation light, but that more functions can be added by connecting additional devices to the conductive means and electric parts and accessories.

The invention claimed is:

1. An LED light, comprising:

at least one first LED installed in the LED light and that serves as a light source for area illumination when the LED light is in a stationary, installed position in which the LED light is connected to an AC outlet or a USB port and the at least one first LED is supplied with power from the AC outlet or USB port;

at least one second LED that serves as a power fail light, flashlight, and/or emergency light, the second LED light being arranged to turn on when the LED light has detected a power failure, and said second LED light also being arranged to be manually turned on and off when the LED light is removed from the stationary, installed position;

a non-powered sound means for generating a sound in response to manipulation by a person; and a removable, extendable and retractable assembly on which the non-powered sound means is mounted.

2. An LED light as claimed in claim 1, wherein the non-powered sound means is removable from the LED light.

3. An LED light as claimed in claim 2, wherein the non-powered sound means is a whistle.

4. An LED light as claimed in claim 1, wherein the non-powered sound means is a whistle.

5. An LED light as claimed in claim 1, further comprising foldable prongs for electrical connection to the AC outlet, and circuitry connected to the foldable prongs for supplying the AC power to the at least one first LED to cause the at least one first LED to illuminate when the LED light is plugged into the AC outlet in the stationary installed position.

6. An LED light as claimed in claim 5, further comprising a DC power source for supplying electrical power to the at least one second LED when the LED light is removed from the stationary, installed position and therefore not plugged into the AC outlet.

7. An LED light as claimed in claim 1, further comprising circuitry for supplying power from the AC outlet or USB port to the at least one first LED to cause the at least one first LED to illuminate when the LED light is in the stationary, installed position.

8. An LED light as claimed in claim 7, further comprising a DC power source for supplying electrical power to the at least one second LED when the LED light is removed from the stationary, installed position and therefore not in the stationary, installed position.

9. An LED light as claimed in claim 1, wherein the LED light includes a base in which the at least one first LED is installed and to which the extendable and retractable assembly is removably attached.

10. An LED light as claimed in claim 9, wherein the at least one first LED and the at least one second LED are installed on opposite sides of a circuit board situated in said base.

11. An LED light as claimed in claim 1, wherein the non-powered sound means is coupled to the LED light by a screw, twist, or quick-release snap-fit connector.

* * * * *